US007494696B1

(12) United States Patent
Wickland et al.

(10) Patent No.: US 7,494,696 B1
(45) Date of Patent: Feb. 24, 2009

(54) COATED METALLIC ARTICLES

(75) Inventors: Shirley M. Wickland, La Crosse, WI (US); James A. Glende, Winona, MN (US); Christopher J. O'Hara, II, Altura, MN (US); Randy R. Dienger, Cochrane, WI (US)

(73) Assignee: Landscape Brands, Inc., St. Louis, MO (US)

( * ) Notice: Subject to any disclaimer, the term of this patent is extended or adjusted under 35 U.S.C. 154(b) by 800 days.

(21) Appl. No.: 10/960,810

(22) Filed: Oct. 7, 2004

(51) Int. Cl.
*B05D 3/00* (2006.01)
*B05D 1/18* (2006.01)

(52) U.S. Cl. ..... 427/435; 427/290; 427/430.1; 427/372.2; 427/375; 427/397.7

(58) Field of Classification Search ..... 427/435, 427/430.1, 307, 290
See application file for complete search history.

(56) References Cited

U.S. PATENT DOCUMENTS 3,008,848 A * 11/1961 Annonio ..... 428/413
4,613,369 A 9/1986 Koehler
5,246,765 A 9/1993 Lussi et al.
5,731,042 A * 3/1998 Glende et al. ..... 427/470
6,238,789 B1 5/2001 Jackson
6,656,526 B2 12/2003 Pan

FOREIGN PATENT DOCUMENTS

DE 4206615 9/1993

OTHER PUBLICATIONS

Belson Outdoors, Plastisol Coated Trash Receptacles, Jun. 18, 2003. www.belson.com/pctr3.htm. 1 Page.*

* cited by examiner

*Primary Examiner*—Timothy H Meeks
*Assistant Examiner*—David Turocy
(74) *Attorney, Agent, or Firm*—Lewis, Rice & Fingersh, L.C.

(57) ABSTRACT

It is now feasible to coat metal objects having a substantially unexpanded surface area with a fused plasticized polyvinyl chloride coating uniformly covering and firmly anchored to the metal object. This objective is achieved by providing a metal substrate to be coated with small anchoring apertures which allow the fused coating to firmly anchor and bond onto and around the metal object and a series of leveling apertures which permit for a more uniform drainage of excessive unfused coating material from the metal object before the fusing of the coating thereto.

4 Claims, 10 Drawing Sheets

COATED METALLIC ARTICLES

FIELD OF INVENTION

The present invention relates to coated metal articles and more particular to metal articles uniformly coated with a fused plasticized polyvinyl chloride coating and the method for making the same.

BACKGROUND OF THE INVENTION

It is conventional to dip coat and fuse a plasticized polyvinyl chloride coating (referred to as fused polyvinyl chloride) upon open structured metal articles (commonly referred to as expanded metals) such as commonly used to protectively coat grated metal outdoor fixtures (e.g. bench seats and tops, waste receptacles, etc.). Dip coating is particularly desirable for many application since it permits the formation of very thick coatings. The dip coating typically comprises preheating a primed and cleaned expanded metal article to a bath immersion temperature, immersing the expanded article into a heated bath of unfused plasticized polyvinyl chloride, removing the metal article from the bath, allowing excessive dip coated polyvinyl chloride material to drain from the article to provide an article coated with an unfused plasticized polyvinyl chloride coating and fusing the polyvinyl chloride coating onto the metal article by passing the polyvinyl chloride coated article through a baking oven.

Open structured or expanded metal articles characteristically have only about 15% or less surface area of a closed structured form which allows such expanded metal articles to be easily and uniformly coated with a plasticized polyvinyl chloride coating material by dip coating. Articles such as metal grates and other highly porous metallic objects which typically contain a high percentage (e.g. greater than a major portion) of open structured coating surface (versus a major solid structure surface area) may accordingly be easily and economically dip coated with an uniform coating of the fused plasticized polyvinyl chloride. Unfortunately, it is not feasible under the existing technology to uniformly coat unexpanded metal articles having planar surface areas in which its centroid is typically six inches or more removed from its planar edge (i.e. its interior portion) and a substantial portion (e.g. more than 50% of its total surface area constitutes a solid material) of the structure therewithin constitutes a solid structure.

In the dip coating process, a desired objective is to create a relatively thick coating which affords greater protection to the coated article against wear and tear as well as weathering. Thicker coatings generally dictate the need to use the more viscous unfused plasticized polyvinyl chloride coating materials in the coating operation. Unfortunately, the more viscous material accentuates the propensity of the coating material to form a non-uniform coating upon the non-expanded areas of the substrate. Equally as perplexing is the inability to produce a coated article having exceptional resistance against peeling.

Attempts to dip coat such solid or unexpanded metallic articles with a fused plasticized polyvinyl chloride coating results in a wrinkled coating exhibiting especially poor adherence to the metallic object. Consequently, abrasive or peeling forces causes the fused coating to be readily separated or peeled from its solid surface. This problem is further compounded by vandalism in which the vandals, being aware that the fused coating may be readily peeled or separated from the coated substrate, will intentionally peel or cut the coating, thus exposing the coated substrate to premature rusting and weathering. Another persistent problem arises by the presence of tear-shaped drops which prominently arise along the peripheral borders or edges of dip coated articles. Under existing technology, it is virtually impossible to obtain a fused dip coating of a substantially uniform layer or coating thickness upon such solid objects. The non-uniformity in fused coating may also be reflected in a wrinkled and motley or pitted surface with pronounced fused droplets accruing along the peripheral edges of the dip coated article. These factors create an unsightly and inferior product of substantially reduced commercial value.

SUMMARY OF THE INVENTION

The present invention provides a coated metallic article characterized as having substantial width and length possessing a uniform coating of a fused plasticized polyvinyl chloride coated thereupon which is firmly bonded to the metallic article and onto itself. This may be accomplished by distributing a sufficient number of small anchoring apertures throughout the non-expanded metal substrate or solid metal portion so as to allow the fused coating to firmly anchor onto the metal substrate in combination with a pre-arrangement of a multiplicity of leveling apertures which allow the unfused plasticized polyvinyl chloride to uniformly coat the metal substrate. When the uniform coating of unfused plasticized polyvinyl chloride upon the metal substrate is then subjected to fusing, the resultant fused polyvinyl chloride coating becomes firmly anchored onto the metal substrate via a bonding together of the fused coating on each side of the metal substrate while also forming a substantially uniform coating thereupon (i.e. substantially uniform in coating thickness). Most coated metallic articles having surfaces of substantial width and length are generally characterized as having at least two major surfaces such as a top surface and a bottom surface such as may be observed by the table tops shown in FIGS. 2-4 and 7-9. Pursuant to the present invention, the two opposing coatings upon each of the major surfaces become fused and bonded together as shown in FIGS. 4 and 9.

The problem of achieving sufficient adherence and anchoring of the fused coating to the metal substrate is overcome by distributing a sufficient number of small apertures (referred to herein as anchoring apertures) so as to firmly anchor and bond the fused plasticized polyvinyl chloride coating together and onto the metal substrate sandwiched therebetween. The anchoring apertures serve as communicating passageways between an upper coating and a lower coating which, when filled with the fused plasticized coating material then ties and bonds to the two surface coatings together.

The problem of irregular coating disposition (e.g. as wrinkles, pitting, droplet formation, unevenness in coating thickness, etc.) of the fused plasticized polyvinyl chloride coating upon the metal substrate prior to fusion is alleviated by the strategically positioning throughout the metal solid surface area to be coated, a sufficient number of large sized leveling apertures of a size and position throughout the metal solid substrate so as to provide the desired drainage of excessive unfused coating material therefrom and to allow for a formation of the uniform coating of fused plasticized polyvinyl chloride thereupon. This results in a metallic article comprised of a solid metal portion having multiplicity of anchoring and leveling apertures coated with a uniform fused plasticized polyvinyl chloride coating covering more than a majority of the total surface area of the coated article.

DETAILED DESCRIPTION OF THE INVENTION

Figure 1:
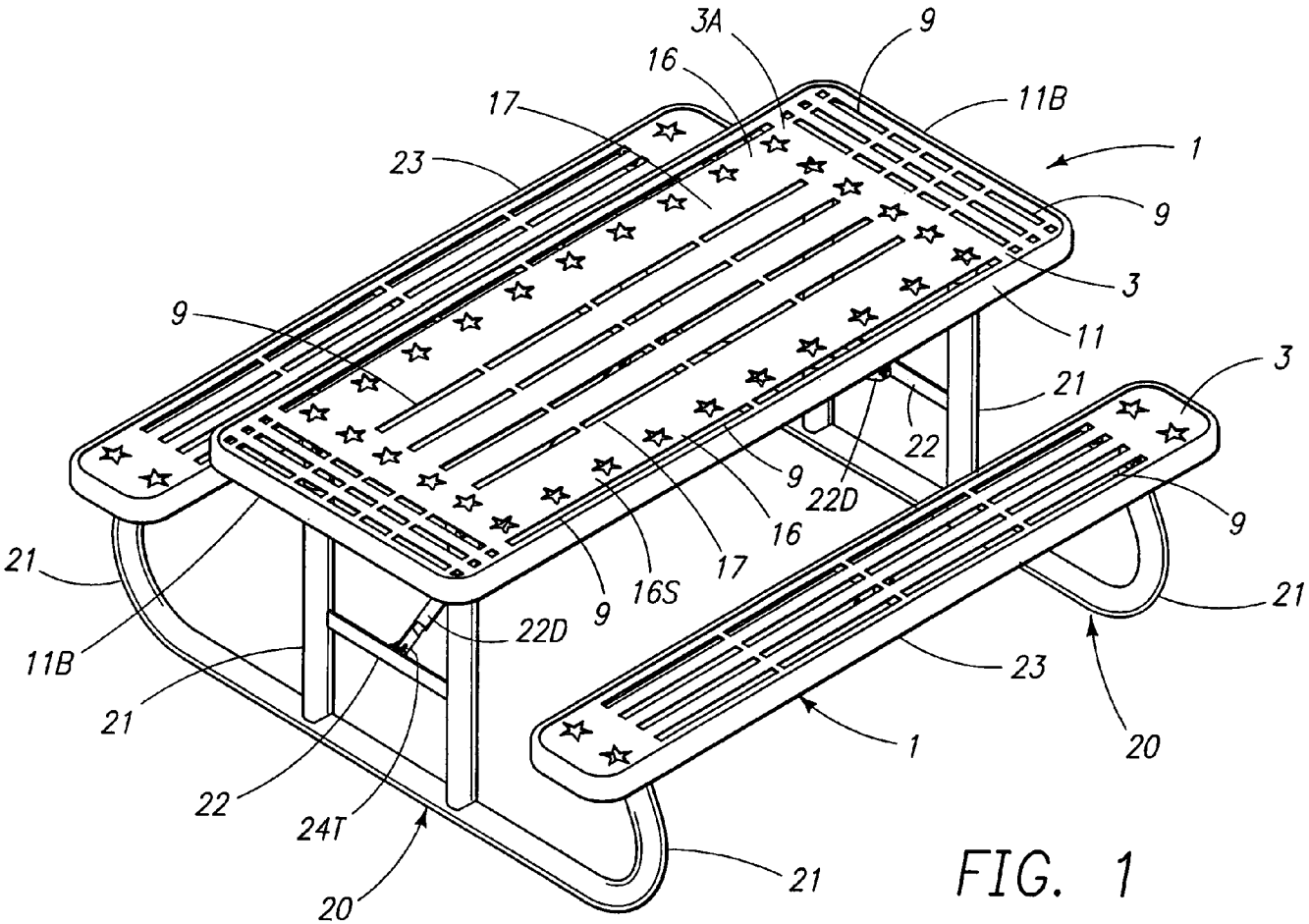
FIG. 1 is an elevational view of a picnic table equipped with coated metallic article of this invention.

With reference to the drawings, there is provided pursuant to the present invention, a coated metallic article 1 uniformly coated with a fused plasticized polyvinyl chloride coating 3, said article 1 comprising a solid metal portion 5 or other suitable substrate constituting a major subsurface area of the total surface area of the metallic article 1, a multiplicity of anchoring apertures 7 uniformly distributed throughout the solid portion 5 in a number and positioning sufficient to firmly anchor the fused plasticized polyvinyl chloride coating 3 onto the solid portion 5 and a sufficient number of larger sized leveling apertures 9 positioned throughout the solid portion 5 so as to provide a substantially uniform layer of the fused plasticized polyvinyl chloride coating 3 bonded onto the solid portion 5 and said anchoring apertures 7. The coated metallic articles 1 depicting the embodiments of the present invention herein are illustrated by the depicted coated table tops 13 and bench seats 23 of FIGS. 1 and 7.

In a conventional dip coating process using a plasticized polyvinyl chloride coating material, a cleaned metal substrate is typically transported through a heated air oven which heats the uncoated metal substrate to a suitable temperature for dip coating with the unfused plasticized polyvinyl chloride coating material. In the present process, the cleaned heated metal substrate 5 may be appropriately immersed while being horizontally suspended by hooks or racks into a tank or bath of heated unfused plasticized polyvinyl chloride coating material for a period of time sufficient to permit the unfused plasticized polyvinyl chloride to completely permeate the anchoring apertures 7 and thoroughly coat the metal substrate 5. The unfused coated metal substrate 5 is then withdrawn from the immersion tank and allowed to drain so as to provide a coated metal article 1 uniformly coated with a unfused plasticized polyvinyl chloride coating 3 which is then passed through a heated oven to fuse and anchor the plasticized polyvinyl chloride onto the metal article 1. As previously mentioned, conventional dip coating and fusing techniques are typically limited to expanded metals and cannot be effectively utilized in the fusion coating of unexpanded metallic objects. In contrast, other metallic objects of smaller dimensional sizes such as rods, brackets, legs, etc., may be effectively coated by powder coating and fusion techniques.

Figure 4:
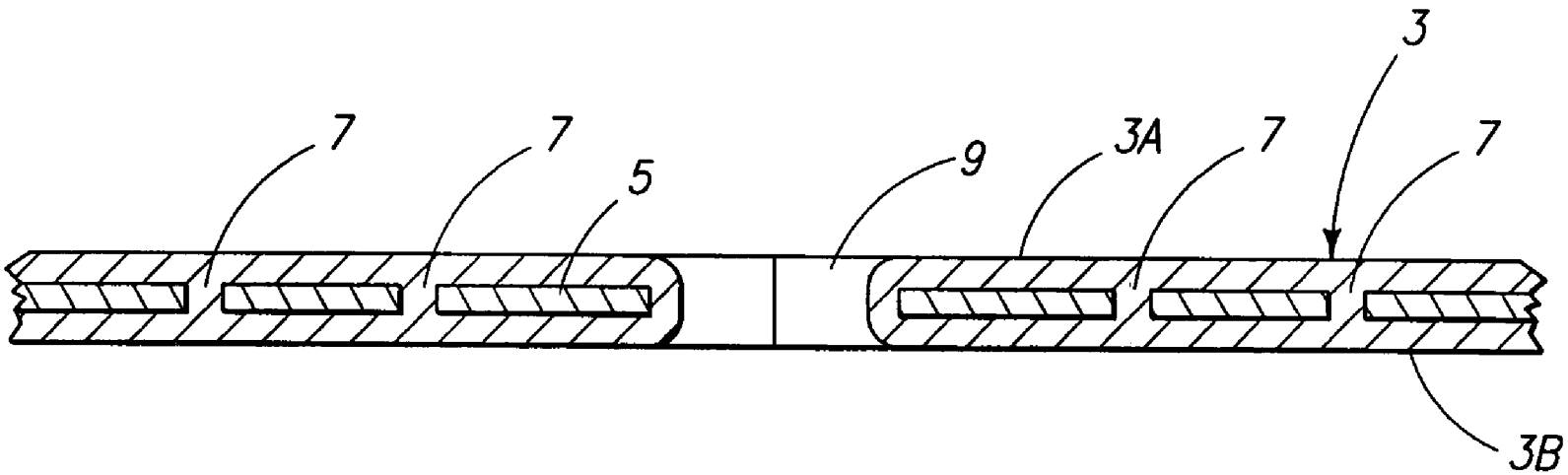
FIG. 4 is an enlarged partial, cross-sectional view of the coated metallic article shown in FIG. 1.
Figure 9:
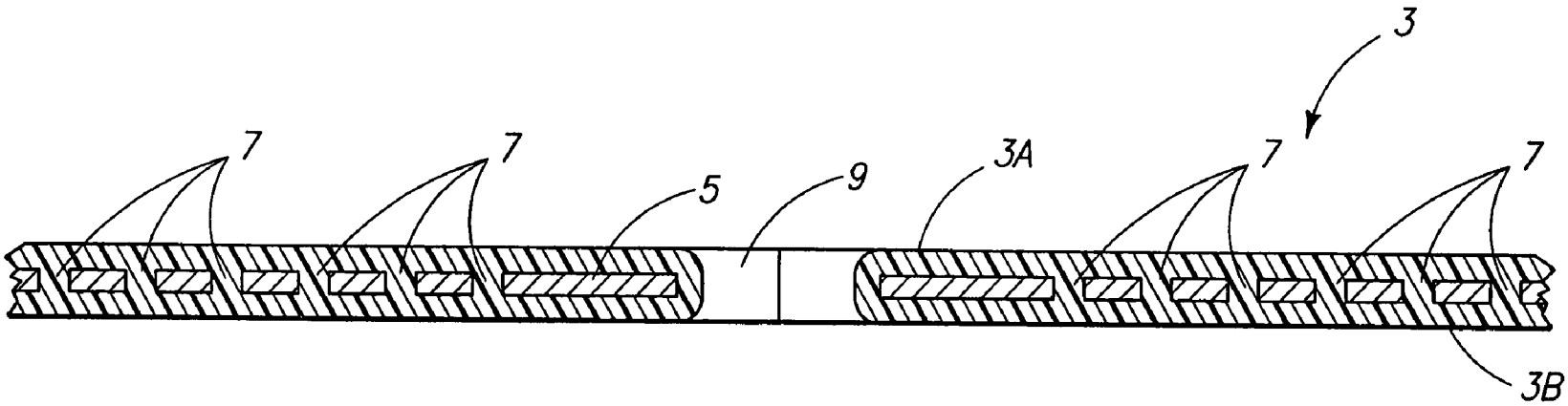
FIG. 9 is an enlarged partial cross-sectional side view of the tabletop shown in FIG. 7.

The coated articles 1 of this invention permit a substantially greater proportion of the total surface area of a metallic article 1 to be uniformly coated with a uniform fused polyvinyl chloride coating 3. Interior surface regions 17 of about six inches or more removed from an open expanded region or edge of the coated material may now be uniformly coated with a tenaciously anchored and bonded fused polyvinyl chloride coating 3. Unlike conventional coated expanded metal surfaces wherein the solid portion typically constitutes but a minor portion (e.g. less than 50%) of the total surface area, the present invention advantageously permits a major portion (i.e. more than 50%) of the total metallic article surface to be uniformly and continuously coated with a fused plasticized polyvinyl chloride coating exhibiting a substantially uniform thickness throughout the coated surface of the metallic article 1. A substantial uniformity in fused coating thickness is reflected by a fused coating thickness which typically does not vary by more (i.e. plus or minus) than 50% of the fused coating thickness. The anchoring apertures 7 serve to anchor and firmly bond the fused coating 3 to the solid metal portion 5 of the metallic article 1 as well as anchoring the opposing coated surface coatings 3A & 3B together as depicted in FIGS. 4 and 9. In the preferred embodiments of the invention, the fused coating 3 uniformly covers the anchoring apertures 7 with a fused polyvinyl chloride coating 3 layer so that the topical surface covering the anchoring apertures 7 rests in substantially the same surface plane as that coating 3 covering the solid portion 5 of the metallic article 1. The leveling apertures 9 afford uniform drainage of excessive coating material of the dipped unfused plasticized polyvinyl chloride coating from the solid portion 5 as well as that surface area surrounding the anchoring apertures 7. Without the presence of leveling apertures 9, the coating thickness of the drained coated metal characteristically exhibits a more highly irregular and non-uniform coating character. Thus, the leveling apertures 9 serve to uniformly level and drain excess unfused coating residue from the dipped coated article 1 during the drainage cycle. This allows the uniformly layered unfused coating to be fused into a fused polyvinyl chloride layer or coating 3 of a more uniform thickness throughout the coated surface 3.

The size and configuration of the leveling apertures 9 may be of any suitable form which affords adequate drainage and leveling of the unfused coating material from the coated solid portion 5. The leveling apertures 9 width must be sufficiently wide so as to allow excessive unfused coating material typically of a relatively high viscosity to drain from the coated article as opposed to the anchoring apertures 7 which passageways become filled throughout with the unfused coating material. The more elongated leveling apertures 9 (e.g. those of a length several fold greater than width) allow for service of a greater drainage basin than those of a lesser length. The ability to service a larger drainage basin area results in a higher percentage of total surface coverage.

The leveling apertures 9 are of a size and uniform distribution throughout the coated article 1 so as to create the desired leveling effect and produce a more substantially uniform deposit of the unfused plasticized polyvinyl chloride coating 3 upon the coated article 1. The leveling apertures 9 also allow bath coatings to uniformly drain from the article as opposed to anchoring apertures 7 which serve as anchoring sites which become filled with the unfused plasticized polyvinyl chloride coating material by bridging and then fusing together the topside coating 3A to the bottom side coating 3B. For most applications, the ultimate objective is to maximize the total surface area coverage by covering at least a major portion (i.e. more than 50%) of the total surface with the fused coating 3. If desired, the total surface area of the leveling apertures 9 (based upon total metal article square surface area) may easily comprise less than 40% and preferably less than 25% of the total surface area of the coated metallic article 1.

The most suitable distribution and size of the leveling apertures 9 will depend mainly upon the total surface area of the metallic article 1 to be coated therewith and, in part, upon the viscosity of the unfused plasticized polyvinyl chloride substrate as applied to the solid portion 5. As a general rule, when metallic articles 1 of a larger cross-sectional distance are dip coated with a more viscous unfused plasticized polyvinyl chloride coating material bath, the leveling apertures 9 will typically require a greater leveling surface area and distribution than when a smaller article or a less viscous polyvinyl chloride coating bath are used in the dip coating operation. However, the viscosity characteristics of the bath also places constraints upon the desired objective to create a thicker and more durable coating upon the metallic article 1. Coating materials of an excessively low viscosity will typically fail to provide the desired protective coating thickness. For most commercial applications, the average coating thickness will generally range from about 50 mils to about 300 mils in thickness. The thinner skinned coatings detract from the desired protective features while excessively thick layers are more costly and no more effective than those of less than 200 mils thickness. A particularly desirable average thickness for the protective coating in most applications ranges from about 100 mils to about 150 mils thickness such as may be accomplished by using a plasticized polyvinyl chloride coating material characterized as having a bath viscosity within about the 3000 to about 3500 centipoise range as measured at 75 degrees F. applied at typical bath application temperatures ranging from about 90 degrees F. to about 115 degrees F. The leveling apertures 9 importantly allow for excessive deposits of unfused plasticized polyvinyl chloride material at an appropriate coating viscosity and temperature to drain from the top side of the coated article through the leveling apertures 9 and back into the dip coating bath without forming excessive droplets on the coated article underside.

Figure 7:
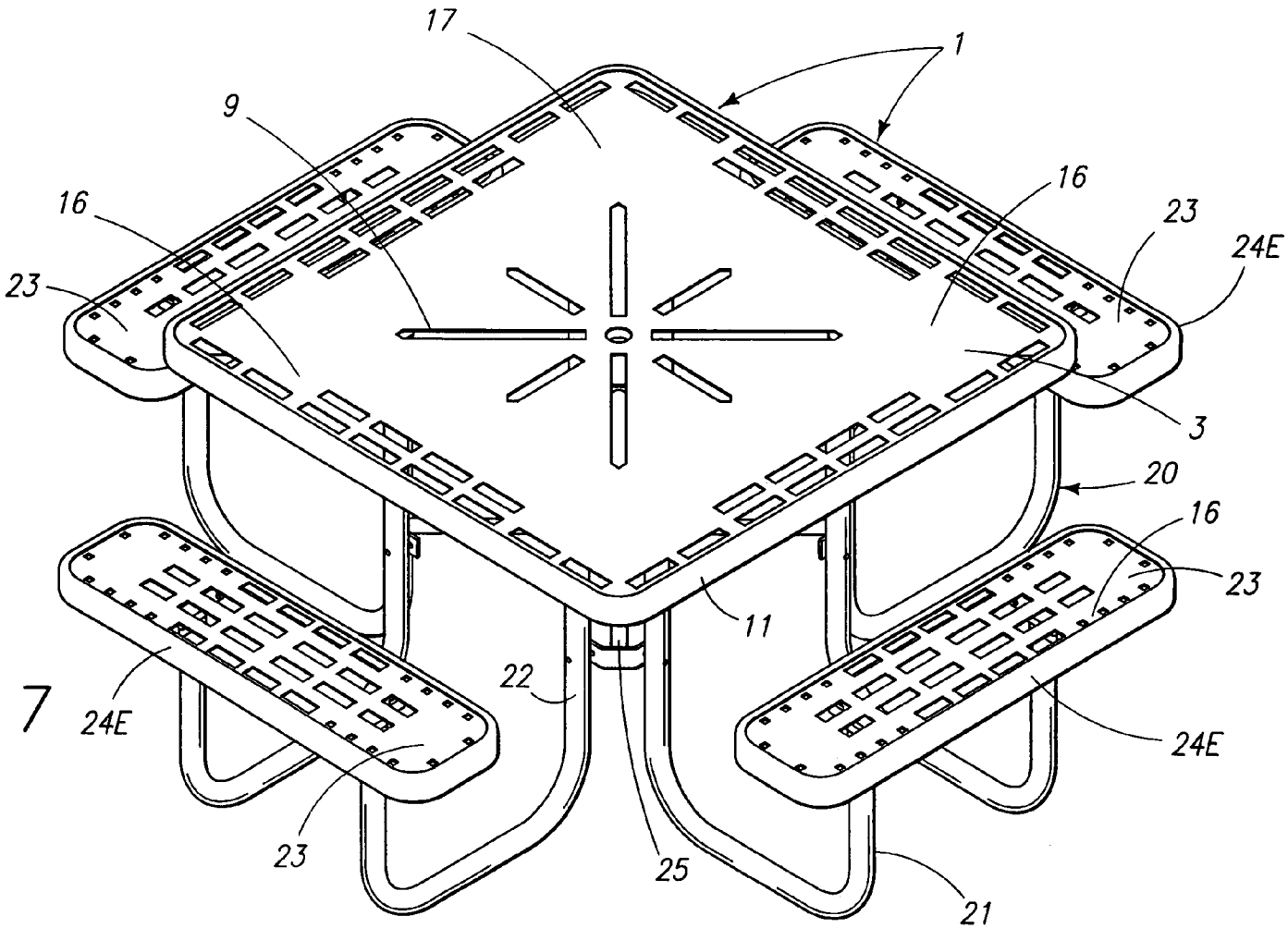
FIG. 7 is a view of the coated picnic table shown in FIG. 6.

The leveling apertures 9 are positioned throughout the solid portion 5 so as to permit a substantially uniform drainage of excessive unfused polyvinyl chloride coating material from the coated surface of the metal portion 5 after its removal from the coating bath. Since the peripheral edges or bordering edges 11 of the article 1 are most susceptible to the formation of hanging droplets during the drainage cycle or step, it is advantageous to increase the surface area density of leveling apertures 9 abounding onto the bordering edges 11 of the article 1 to be coated. As a general rule, the outer peripheral margin 16 extending up to about eight inches from the peripheral edge 11 will suitably include about a four to about a five fold increase in leveling apertures 9 from that normally required to provide adequate drainage of an internally disposed region 17 defined as being more than eight inches removed from the peripheral edge 11 of the coated article 1. Elongated leveling apertures 9 appropriately positioned within about one to about four inch margin of the peripheral edge 11 of the article 1 (especially within a three inch margin) will effectively prevent damming and normally allow for the expeditious removal of excessive unfused coating material from the metal article 1 and thereby provide a coating 3 of a substantially uniform thickness. Slotted leveling apertures 9 in substantial lateral alignment with the bordering edge 11 such as shown in the Figures afford particularly effective leveling protection and against the formation of fused droplets along the peripheral edge 11. Leveling apertures 9 within the interior portions 17 in the form of elongated slotted apertured form such as depicted by the coated picnic table tops of FIGS. 1 and 7 are particularly effective for leveling excess coating materials from the internally disposed surface areas or interior portions 17 of the coated metal article 1. In general, the more elongated leveling apertures 9 of sufficient cross-sectional width to allow drainage and form a uniform coating layer about its open surfaces (as depicted by FIGS. 4 and 7) will provide a more effective drainage basin for a larger surface area or basin area than those leveling apertures 9 of the non-elongated form. Effective arrangement of the leveling apertures 9 of sufficient widths to permit drainage but not excessive in width allows for a more effective increase in total coated solid surface area of the coated article 1.

The uncoated picnic table top assemblies 13 shown in FIGS. 2, 3, 6 and 8 illustrate an appropriate balanced combination of leveling apertures 9 and anchoring apertures 7 to provide a substantially uniform fused plasticized polyvinyl chloride coating 3 of a desired protective thickness firmly fused and anchored to the table top 13. The two opposing fused coatings 3 comprising the top surface coating 3A and bottom coating 3B fused together by the fused coating 3 bridging between the top coating 3A and bottom coating 3B through the plurality of communicating passageways afforded by the anchoring apertures 7 as are illustratively depicted in the enlarged cross-sectional views of FIGS. 4 and 9. Since most coated metallic articles 1 having particular application to the coating embodiments of this invention may be generally characterized as having two major dimensional coated surface areas (e.g. such as top 3A and bottom 3B surfaces) with an internal midpoint typically of more than one-half a foot removed from a bordering edge 11, the depicted table tops 13 are particularly well suited for illustrating the protective coating embodiments of this invention. The decorative leveling apertures 9 along the peripheral margins 16 of the table tops 13 as shown in the drawings includes those within the terminal end margins 16E and the side margins 16S all of which are especially designed to create a sufficient open or expanded structure to allow for effective drainage without necessitating the anchoring apertures 9.

For most applications (e.g. when using a bath containing a unfused plasticized polyvinyl chloride coating material for optimum coating thickness), the leveling apertures 9 of a mean cross-sectional diameter greater than about ¼ inch will tend to serve more effectively as a leveling apertures 9 whereas conversely those apertures less than ¼ inch cross-sectional width will function much less effectively. By way of Example, a relatively long aperture (e.g. three or more inches long) measuring less than ⅛ inch in width will tend to function more as anchoring aperture 7 since the unfused coating material will merely tend to impregnate and become entrapped within the narrow aperture passageway. Upon a minimum width basis, a leveling aperture 9 will typically have a minimum width of more that ¼ inch, advantageously at least ⅓ inch width and preferably a minimum width of at least ½ inch. If desired, part of an extended aperture may serve as a leveling aperture 9 while the narrower portion may serve as an anchoring aperture 7. Since the desire of the invention is to increase the coated surface area, the maximum width will generally be constrained by the desire to maximize the closed structure of the desired solid portion 5. For most applications, the maximum width for a major portion of the leveling aperture 9 is desirably less than two inches and preferably less than one inch. For most applications, a major number of the leveling apertures 9 will have a minimum width ranging from about ½ inch to about three inches and most typically from about one inch to about two inches.

The lateral distance between the leveling apertures 9 is also a factor in contributing to the ability to manufacture a substantially smooth fused coating 3 surface of a substantially uniform coating thickness of plus or minus 50% variation in thickness. The lateral distance between adjacently positioned leveling apertures 9 will typically be less than six inches and most advantageously less than about three inches. Since a desirable objective of the invention is to enhance the total coated surface area of the interior portion 17 of the article 1, the leveling apertures 9 within the interior portion 17 may easily constitute less than 40% of the total surface area of the interior portion 17 and more desirably less than about 25% of the total surface area encompassed within the confines of the peripheral edges 11 of the coated metallic article 1. In the more limited embodiments of this invention allow for the ability to uniformly coat and drain solid metal substrates 5 wherein the total surface area occupied by the leveling apertures 9 ranges from about 4% to 20% of the total square surface area of the article 1. Particularly effective uniformly in coating 3 may be accomplished through a substantially uniform distribution of leveling apertures 9 serving from about 5% to 15% of the total square surface area and easily less than 10% of the interior portion 17 of the coated article 1.

As previously mentioned, the peripheral margins 16 of the solid portion 5 generally necessitates more drainage (meaning increased leveling apertures 9 surface area) than the more internally disposed portions 17 of the solid portion 5. At a lateral distance of more than six inches removed from the peripheral edge 11 of the solid portion 5, the leveling apertures 9 may suitably occupy a total surface area ranging from about one inch squared to about sixteen inches squared per square foot (e.g. 0.79%-11.1% of the total surface area) and advantageously will range from about two to about four square inches per square foot (e.g. about 1.4% to about 2.8%) of internally disposed surface area.

Anchoring apertures 7 are generally required within the interior portion 17 especially of six or more inches removed from the bordering edges 11 so as to firmly anchor the fused coating 3 together and onto the sandwiched solid portion 5. The anchoring apertures 7 provide anchoring passageways which allow unfused plasticized polyvinyl chloride composition to penetrate the interior regions of the solid portion 5 and thereby allow opposing face coatings 3A & 3B to conjointly fuse together. The anchoring apertures 7 serve to collect and become impregnated with the coating composition while also allowing an enveloping coating layer to develop above the anchoring apertures 7 of substantially the same uniform thickness as that coating 3 thickness existing above the solid portion 5 as depicted by the enlarged cross-sectional views of FIGS. 4 and 9. In contrast, the leveling apertures 9 allow the coating excesses to drain from the top surface through the leveling apertures 9 and back into the dipping bath above which the metal portion 5 coated with excessive unfused coating material is typically suspended for drainage. The anchoring apertures 7 are desirably present in a greater abundance (i.e. number) within the interior portion 17 of the coated article 1 than the leveling apertures 9. The number ratio of anchoring apertures 7 to leveling apertures 9 will typically be at least 3:1 and most typically at a value of at least 10:1. Even though the anchoring apertures 7 are more prevalent than the leveling apertures 9, the total surface area occupied by the anchoring apertures 7 will remain substantially less in size. In most applications, typically less than 10% and most typically less than 5% of the total planar surface area of the article 1 will be occupied by the anchoring apertures 7 while in contrast the leveling apertures 9 may typically constitute more than 5% but less than 25% of the total surface area of the coated article 1. Particularly effective anchoring of the fused coating 3 may be achieved when the anchoring apertures comprise from about 0.5% to about 4% and preferably from about 1% to about 3% of the total surface area of the coated article 1.

As may be observed from the uncoated solid portion 5 shown in FIGS. 2-3, 5, 5*a* and 8, the anchoring apertures 7 are shown as apertured fields comprised of a multiplicity of anchoring apertures 7 uniformly disposed amongst an array of leveling apertures 9 strategically positioned within the solid portion 5 so as to permit uniform drainage and coating thereof. The cross-sectional size or diameter of the anchoring apertures 7 should be sufficient to permit the unfused polyvinyl chloride coating to permeate the anchoring aperture 7 passageways and to form a fused coating 3 on both coating sides 3A & 3B immediately above the respective anchoring aperture 7 such that the coating surface immediately thereabove has substantially the same surface plane or coating thickness as that of surrounding juxtapositional coating 3 coated upon the adjacently coated metal portion 5 as shown in the cross-sectional views of FIGS. 4 & 9. If the coating surface above the anchoring apertures 7 forms a depressed surface region, the anchoring apertures 7 may be excessively large for the viscosity of the particular unfused plasticized polyvinyl chloride material as used in the coating operation. Such depressions about the anchoring apertures 7 will tend to arise if the intended anchoring apertures should have a cross-sectional mean diameter of more than ¼ inch at the coating viscosity of the coating material typically used in the coating bath. Conversely, if too small anchoring apertures 7 are used for the viscosity of the polyvinyl chloride material applied in the dip coating process, insufficient permeation, anchoring and fusion between coating interfaces of the opposing fused coating 3A & 3B to the metal substrate 5 can arise.

The positioning and need for anchoring apertures 7 is also dictated by the remoteness of the solid metal portion 5 to be coated from a drainage basin or open structure afforded by the leveling apertures 9. As the solid portion 5 becomes more closed (e.g. see FIGS. 2-6) and as the need to create more solid surface coating 3 upon the solid portion 5 increases, the need for anchoring apertures 7 correspondingly increases in order to securely anchor the necessary fused coating 3 onto the solid portion 5 by the fusing together of the coatings upon opposite faces of the solid portion 5 to form an integrated fused coating 3 bridging from one coated side to the other through the anchoring apertures 7. As a practical consideration, the maximum number limit for the anchoring apertures 7 will be primarily dictated by the practicality and expense involved in creating the anchoring apertures 7 and structural strength loss of the coated article 1 which may arise by the excessive presence of the anchoring apertures 7.

In preparing the metal portion 5 for manufacture, the internally disposed regions 17 of the solid portion 5 will include a prearrangement of a sufficient number and positioning of anchoring apertures 7 so as to firmly anchor and conjointly fuse opposing surfaces (3A & 3B) of the fused polyvinyl chloride coating 3 to the solid substrate 5. For any given square inch area of more than 3 inches removed from any given leveling aperture 9 within an internally disposed region 17 of the coated article 1, the solid portion 5 will suitably contain on an average of a least one anchoring aperture 7 per square inch. For most applications, a major number of the anchoring apertures 7 will advantageously be laterally positioned apart from each adjacently positioned apertures 7 at a mean lateral distance of less two inches and preferably less than 1½ inch and most preferably within a mean lateral distance ranging from about 0.25 inch to about one inch.

The most suitable prearrangement and number of anchoring apertures 7 for any given manufacture may be determined by subjecting the fused polyvinyl chloride coating 3 coated upon the coated article 1 to a peel test (ASTM WK214) to determine how firmly the fused coating 3 is anchored to the solid portion 5. If the peel test reveals a peel force of less than fifteen pounds, then it is advantageous to increase the average number of anchoring apertures 7 so as to yield a peel strength greater than twenty-five pounds and preferably to at least 40 pounds. The anchoring apertures 7 needed to provide satisfactory anchoring to the metal portion 5 within the interior portion 17 is typically more than twenty-five but less than two thousand anchoring apertures 7 per square foot. Peel strength is enhanced when those anchoring apertures 7 within the interior portion 17 and more than three inches removed from the leveling aperture are present in number greater than fifty per square foot and advantageously more than seventy-five in number per square foot of surface area. In general, anchoring apertures 7 of a mean average number ranging from about 0.05 to about 5.0 per square inch within an interior portion 17 and most typically of a mean average number ranging from about one to about three anchoring apertures 7 per square inch will yield a particularly desirable anchoring and fusing effect.

Although the anchoring apertures 7 may vary in configuration (e.g. small open crevices, elongated and irregular open passageways extending through the solid portion 5, deep etchings, etc.) as needed to provide the desired coating anchoring, they must necessarily be of sufficient depth to provide anchoring of the fused coating 3 to the solid portion 5 and have a maximum width so as to retain unfused coating material therewithin. Anchoring apertures 7 bored or stamped through the solid portion 5 so as to form small open passageways passing entirely through the solid portion 5 may be easily fabricated by conventional punch pressing or drilling techniques. Such communicating passageways bridging across both major surface of the solid portion effectively meld and conjointly fuse the fused coatings 3 on each side of the coated solid portion 5 together. Such open ended anchoring apertures 7 passageways also allow entrapped air to escape from the anchoring apertures 7 when immersing the solid portion 5 in the coating material bath. The preferred range of the anchoring apertures 7 ranges from about 1% to about 3% of the total surface area of the coated article 1, and the numerical ratio of anchoring apertures 7 to leveling apertures 9 preferably ranges from about 30:1 to about 55:1.

The size of the anchoring apertures 7 will be small enough to provide coating continuity in surface smoothness and uniformity while also being of sufficient size to allow the unfused polyvinyl chloride to thoroughly permeate into the interior passageways of the anchoring apertures 7. The more viscous unfused polyvinyl chloride baths may require a larger aperture size than those when using the less viscous baths. Anchoring apertures consisting essentially of open passageways having a cross sectional diameter of less than 0.30 and more appropriately in typical applications of a mean cross section diameter or width of greater than 0.10 inch and less than 0.20 inch have been found to provide exceptional anchoring and coating attributes.

Pursuant to the present invention there is also provided a method for preparing a coated metallic article 1 uniformly coated with a fused plasticized polyvinyl chloride coating 3. Suitable coating substrate for such metallic articles 1 are generally characterized as having a solid metal portion 5 or substrate which constitutes at least a major surface area of the total surface area (advantageously more than 70% and preferably more than 85%) of the solid metal portion 5, and contain a multiplicity of anchoring apertures 7 distributed throughout the solid portion 5 in a number and positioning sufficient to firmly anchor and bind the fused plasticized polyvinyl chloride coating 3 onto the solid portion 5 and a sufficient number of larger sized leveling apertures 9 positioned throughout the solid portion 5 so as to provide a substantially uniform layer of the fused plasticized polyvinyl chloride coating 3 bonded onto the solid portion 5 and said anchoring apertures 7. The present method comprises:

a) providing a prearrangement of the anchoring apertures 7 in a sufficient number and uniform distribution throughout an interior portion 17 of the metallic article 1 so as to permit the fused polyvinyl chloride coating 3 to firmly anchor and bond onto the metallic article 1, b) selectively positioning the larger leveling apertures 9 throughout the metallic article 1 so as to allow an excessive deposition of an unfused plasticized polyvinyl chloride coating to uniformly drain from the metallic article 1 and form a substantially uniform coating of unfused plasticized polyvinyl chloride uniformly coated onto the metallic article 1, c) uniformly coating the metallic article 1 with an unfused coated plasticized polyvinyl chloride coating material by allowing the unfused coating material to impregnate the anchoring apertures 7 and coat the solid portion and anchoring apertures therewith while also permitting excessive deposits of the unfused coating material to drain from the metallic article 1 so as to provide the solid coated metal article 1 characterized as having substantially uniform layer of the unfused plasticized polyvinyl chloride coating material uniformly covering the solid portion 5 and the anchoring apertures 7, and d) fusing the unfused plasticized polyvinyl chloride coating material upon the metallic article 1 to provide a fused plasticized polyvinyl chloride coating 3 uniformly covering the solid portion 5 and the small anchoring apertures 7 with the fused coating 3 being firmly anchored onto the anchoring apertures 7 of said metallic article 1.

Although the present invention is primarily illustrated by table tops 13 and bench seats 23 using both the leveling apertures 9 and anchoring apertures 7 to provide the desired uniformly thick and peel resistant coatings 3, the invention may be applied to any other article possessing a sufficient interior surface area of unexpanded structure so as to require the leveling 9 and anchoring apertures 7 to create the desired anchoring and leveling attributes of this invention. Planar as well as curvilinear surfaces of diverse structure and configuration may also be effectively coated by this technology. Illustrative of such other coated metallic articles (particularly outdoor fixtures) include benches, chairs, protective screens, waste receptacles, lounge chairs, and the like.

The following Examples illustrate the unique coating embodiments of this inventions:

EXAMPLE 1

A coated article 1 in the form of a picnic table embodying the leveling apertures 9 and anchoring apertures 7 was made from standard metal stock components. The picnic table top assembly 13 was fabricated with an effective amount of anchoring apertures 7 and leveling apertures 9 so as to create a substantially smooth, uniform and continuous fused plasticized polyvinyl chloride coating 3 firmly bonded to uncoated solid portion 5 of the picnic top 13 and fused to itself. The depicted table top 13 of FIG. 1 contains a sufficient closed surface area so as to require the implementation of both the leveling apertures 9 and anchoring apertures 7 to firmly anchor and conjointly fuse the extended table top surface coatings 3A & 3B together. The picnic table legs assembly 20 including the unshaped frame construction with extending bench seat leg section 21 and table top support legs 21 were made from a 2⅜ inch diameter tubular steel stock bent so as to provide support for the bench seats 23 for both the table legs 21 as shown in FIG. 1.

Figure 2:
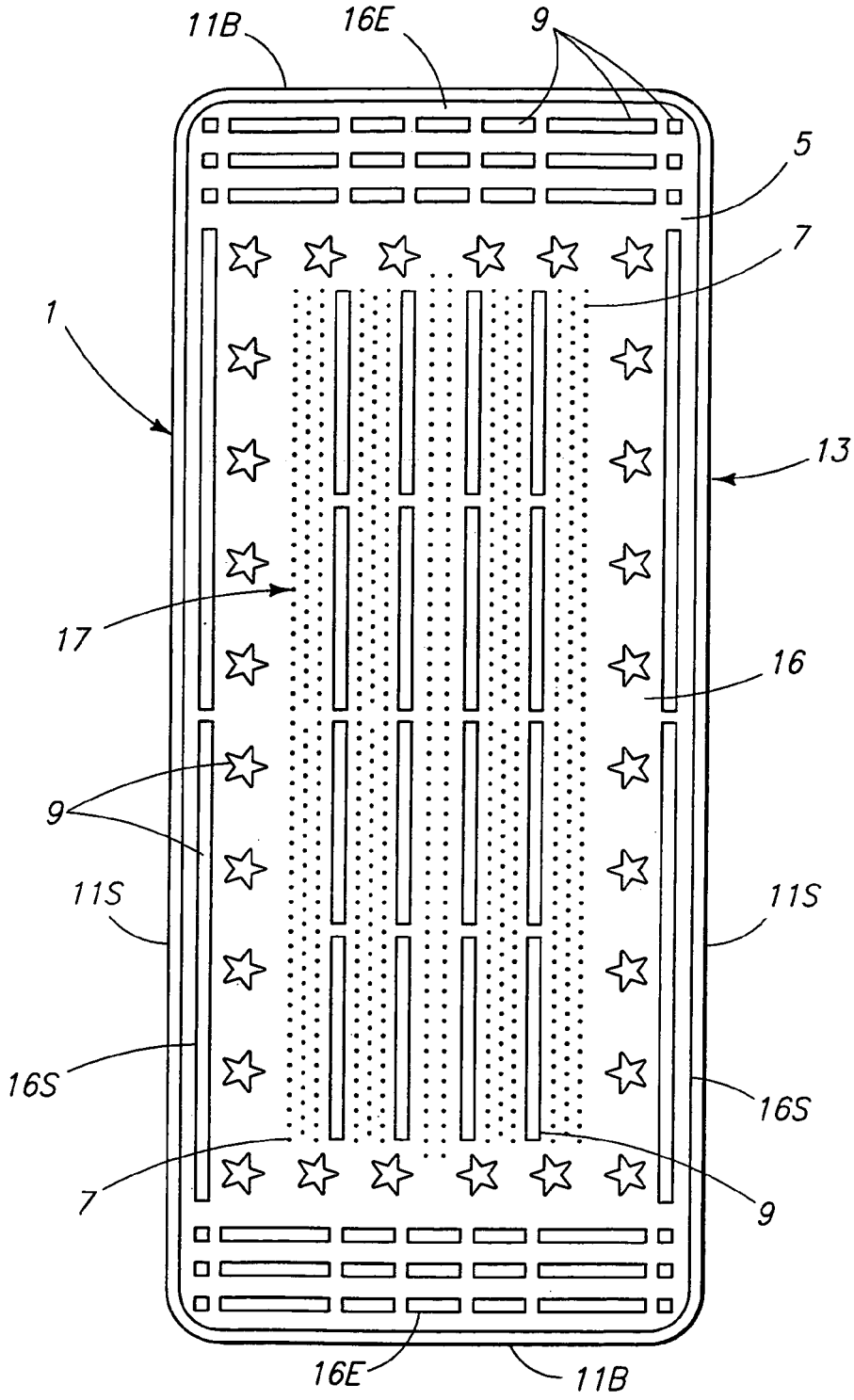
FIG. 2 is a top view of an uncoated table top used in the manufacture of the table top shown in FIG. 1.
Figure 3:
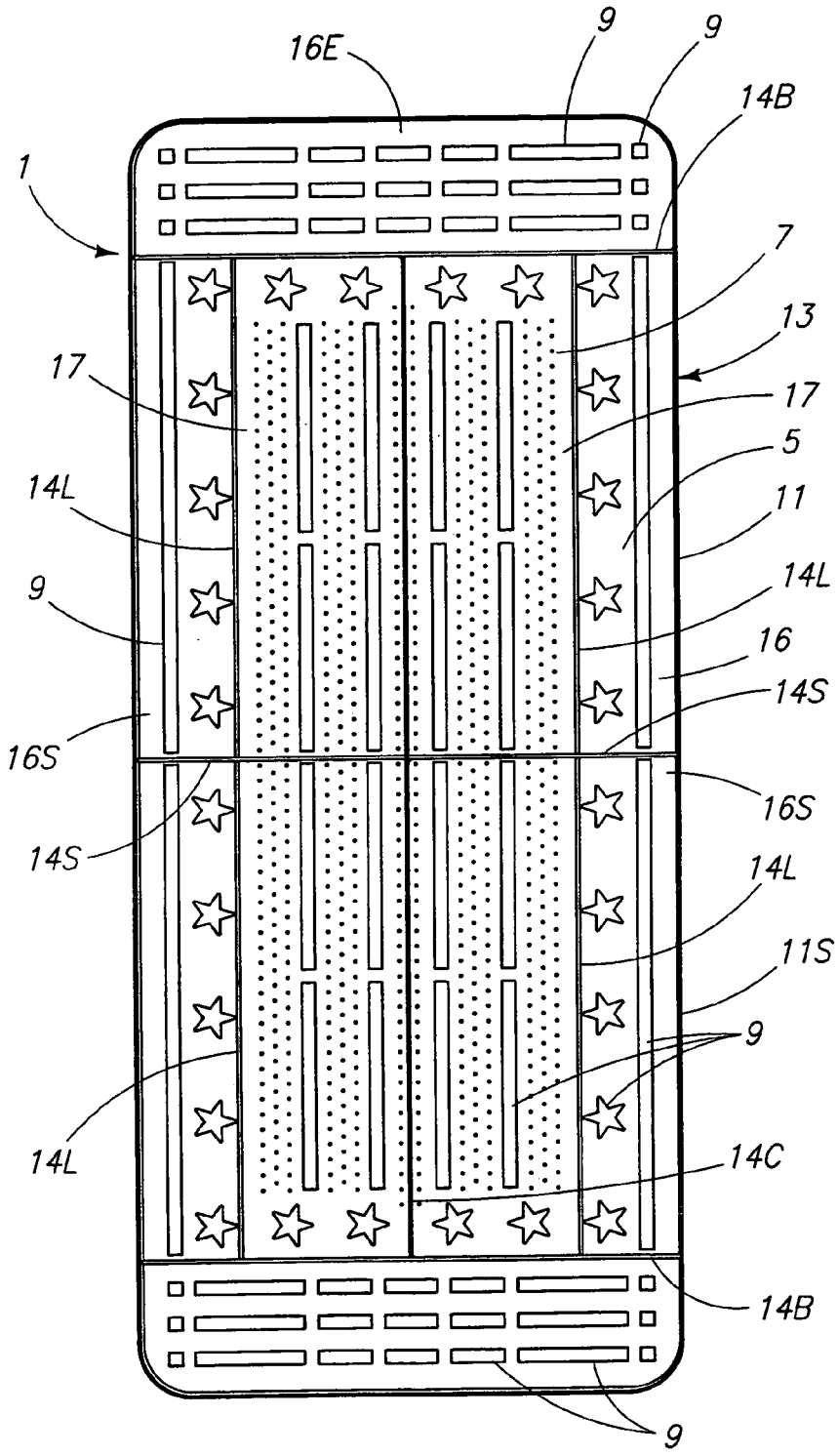
FIG. 3 is an underside view of the uncoated table top shown in FIG. 2.
Figure 5:
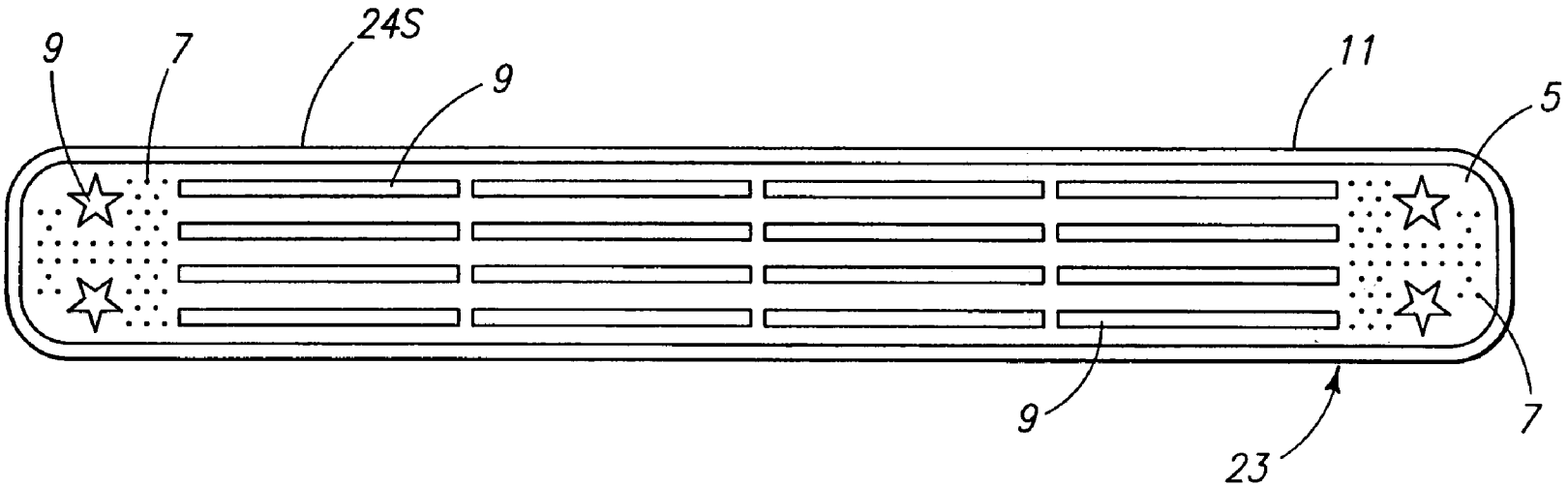
FIG. 5 is a top view of an uncoated bench seat used to prepare the coated bench seat article shown in FIG. 1.
Figure 5A:
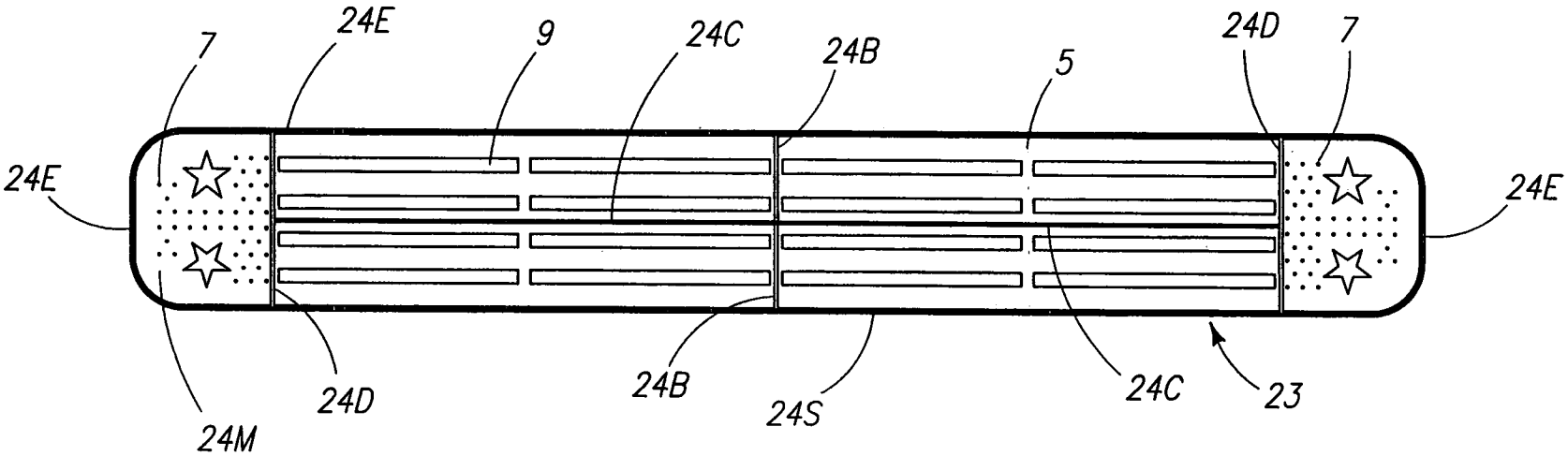
FIG. 5*a* is an underside view of FIG. 5.

The uncoated table top 13 assembly as shown in FIGS. 2 and 3 as well as the uncoated bench seats 23 shown in FIGS. 5 and 5*a* were braced by welding onto the table top 13 and bench seats 23, the underside table top bracing 14, and the seat braces 24, and bordering edging 11 bracing about the seat bench edges and table top edge.

The underside bench seat braces (generally prefixed by 24) as shown in FIG. 5A, include the bench seat center brace 24C measuring 0.125 inch thick by 1.5 inch in width by 55.75 inches in length of steel bar stock fillet welded onto the two terminating bench seat braces 24F of steel bar stock (measuring 0.1875 inch thick by 1.25 inches in width and 9.75 inches in length) as well as the bisecting seat braces 24B (0.1875 inch thick by 1.25 inches in width by 4.75 inches in length). A bench seat edging 24S of 10 gauge coil steel (0.1345 inch thickness) measuring 2.375 inches width and 158.125 inches long was wrapped around the bench seat perimeter and flushly welded to the bench seat top and by welding the wrapped-around ends together to provide a continuous bench seat edge 24S depicted in FIGS. 1-3, 5 and 5*a*. The abutting ends of the terminating end braces 24F and bisecting seat braces 24B were also welded onto the abutting bench seat edging 24S to complete the underside bracing of bench seat 23.

The two diagonal leg brace supports 22D were constructed of FloCoat 14 gauge pipe (1.05 inch outside diameter) cut to 31.125 inches in length and fitted with bolt holes (not shown) at each end for bolting onto a bolt receiving tabs 24T end (which as depicted were welded onto the inner bisect of leg cross brace support 22) and bolted at the opposite end thereof onto a mating bolt receiving aperture (not shown) of table top center brace 14C. The two table top leg braces 22 bridging between table top legs 21 were also bolted thereto.

The remaining components of the picnic table 13 shown in FIG. 3 including the table top leg braces 22, diagonal leg brace supports 22D, bench seat legs 21 and table top leg supports 21 were powder coated in accordance with the powder coating and fusion techniques as described in U.S. Pat. No. 5,891,579 to Glover et al. In this procedure, two bench legs sections 20 with the diagonal leg brace support 22D welded thereto were powder coated separately and assembled onto mounts affixed to the underside seat bracing 24 and table top bracing 14 to provide the finished article or picnic table 1 as shown in FIG. 1.

With particular reference to the uncoated table top 13 views of FIGS. 2 & 3 used to prepare the coated article 1 of FIG. 1, the table top 13 was fabricated from a 10 gauge steel sheet stock measuring 6 feet in length and 2½ feet in width from which the anchoring apertures 7 and leveling apertures 9 were made by punch pressing preset to produce the depicted table top 13 of FIGS. 2 & 3. The circular shaped anchoring apertures 7 (measuring about 0.1250 inch to about 0.1500 inch in diameter) in rows were prearranged to create the desired anchoring effect. The anchoring apertures 7 rows were laterally spaced at 0.1416 inch apart from one another. The anchoring apertures 7 were arranged in an outer rowed series of four matched parings (two on each side) of three staggered rows commencing 11.5330 inches removed from the longitudinal table ends 11B and beginning with 6.8897 inches removed from the longitudinal side edges 11S of the table top 13. By staggering the positioning of the anchoring apertures 7 in a repetitive sequence of off-set rows as shown in FIGS. 2 and 3, the distance between adjacently positioned anchoring apertures 7 within each row as well as that of the adjacently positioned neighboring anchoring apertures 7 in the next adjacent row may be maintained at a neighboring equidistant (0.8563 inch) from one another.

As may be further observed from the uncoated picnic table top assembly 13 shown by FIGS. 2 & 3, the two terminal end margins 16E of table top 13 measuring 10.7188 inches distance removed from the peripheral end edge 11B are shown as having a greater density of leveling apertures 9 and surface coverage (as evidenced by the presence of more leveling apertures 9 depicted as rectangular apertures of various lengths, and star-shaped leveling apertures 9 than those present within the interior portion 17. The leveling apertures 9 are arranged within the end margins 15E in a number and at a sufficient close proximity to one another so as to afford uniform leveling and drainage of any excessive unfused plasticized polyvinyl chloride coating which may cling or drip from to the table top assembly's surface after its removal from its immersion from the coating bath.

The longer depicted rectangular leveling apertures 9 (six in number) along the peripheral end margin 16E (measuring 6.0313 inches by 0.7500 inch in width for total 27.1409 square inches), the smaller square leveling apertures 9 (measuring 0.5625 inches square for a total of 3.375 squared inches) and the nine internally disposed intermediate sized leveling apertures 9 (measuring 2.9375 inches by 0.7500 inch in width for a total 19.8281 square inches) were aligned in three rows with each row of the leveling apertures 9 being spaced laterally 1.25 inches apart and each leveling aperture 9 within each row being spaced 0.75 inch apart. Based upon the table top's 13 total surface area, the anchoring apertures 7 constituted only 1.33% of the total surface area while the leveling apertures 9 amounted to 22.38% of the total surface area with a balance of 76.29% representing the solid portion 5 of table top 13. Further removed from the table end margins 16E are the five pointed star leveling apertures 9 which measure diagonally from tip to tip 2.3386 inches (for a total of 5.7927 square inches each) and which are centered at a position of 3.1397 inches removed from the adjacently positioned rectangular leveling apertures 9 at a centered distance of 4.1810 inches apart. The star-shaped leveling apertures 9 contribute decorative leveling and anchoring of the fused plasticized polyvinyl chloride coating 3 to the table top 13. The openness of the table top's 13 peripheral end margin 16E structure as created by the abundance of leveling apertures 9 alleviates the need for anchoring apertures 7 about the peripheral end margin 16E in order to securely bond the fused plasticized polyvinyl chloride coating 3 to the table top 13.

Similarly, the decorative star and rectangular leveling apertures 9 strategically positioned along the side margins 16S of the table top 13 provide a sufficient open structure so as to likewise uniformly level and anchor the fused plasticized polyvinyl chloride coating 3 to the side margins 16S of the table top 13. The dimensions of the star-shaped leveling apertures 9 along the side margins 16S (centered 4.1810 inches from side edge 11S) are identical to those along the end margins 16E. The paired rectangular side margin apertures 9 (two on each side) measuring 27.5938 inches in length by 0.7500 in width are positioned 1.5625 inches removed from the terminating side edge 11S of the table top 13 and 1.8010 inches removed from an imaginary line running through the center of each star 9. It may be further seen from FIGS. 2-3 that the positioning of the more lengthy elongated leveling apertures 9 along the table top peripheral end margins 16E facilitates more effective drainage of the unfused coating film to provide a substantially smooth film thickness, while also being highly effective in preventing droplet formation along the table top terminating end 11B. The openness of the decorative leveling apertures 9 along the side margin 16S of the table top 13 contributes to the desired anchoring and leveling effect of the plasticized polyvinyl chloride coating 3 thereto.

The internally disposed leveling apertures 9 within the interior portion 17 are arranged as four elongated rectangular apertures (each measuring 0.7500 inch in width×11.6350 inches in length) in four rows laterally spaced 2.9375 inches apart with each elongated rectangular leveling aperture 9 within each row being separated by a 0.7500 inches wide strip of the 10 gauge steel solid portion 5. The internally disposed leveling apertures 9 were centered so that the two center leveling apertures 9 were centered onto the bisecting longitudinal axis of the table top 13 in a placement 0.7272 inches laterally removed from the nearest adjacent row of anchoring apertures 7. These internally disposed leveling apertures 9 are sized and positioned within the field of anchoring aperture 7 so as to provide a uniform drainage basin for the interiorly disposed surface area covered by the fused coating 3.

The uncoated interior portion 17 of the table top 13 as illustrated in FIGS. 2-3 lacks sufficient expanded structure and thus necessitates the anchoring apertures 7 to firmly anchor the fused plasticized polyvinyl chloride coating onto the interior portion 17 of the table top 13. The uncoated interior portion 17 of the table top 13 thus shown in FIGS. 2 & 3 illustrates an appropriate balance of anchoring apertures 7 and leveling apertures 9 to provide the necessary uniformity in leveling and anchoring of the fused plasticized polyvinyl chloride coating 3 by conjoint fusing of the opposing coated surfaces 3A & 3B onto the table top 13. In comparison to the 25.52% of open to solid structure surface area of the outer peripheral margin 16 of the table top 13 shown in FIGS. 2 and 3, the interior portion 17 comprises less than 14.85% total open structure which in turn necessitates the presence of the combined usage of the leveling apertures 9 and the anchoring apertures 7.

The outermost anchoring apertures 7 running parallel along and 6.8897 inches removed from the side margin 16S are positioned at about 2.6512 inches removed from the imaginary line running through the centroid of the stars. The depicted anchoring apertures 7 are aligned in staggered rows of three rows disposed on each side of the leveling apertures 9 with each anchoring aperture 7 row being laterally placed 0.7416 inches apart from one another. Those anchoring apertures 7 resting adjacent to leveling apertures 9 are positioned 0.7834 inches laterally apart. Each of the paired outer row of anchoring apertures 7 contain fifty-eight anchoring apertures 7 which laterally commence and end at the end of the leveling aperture 9 of each row while each of the middle rows of the anchoring apertures 7 numbering fifty-six in number are staggered so the each middle anchoring aperture 7 forms a midpoint between each of the four juxtapositioned anchoring apertures 7 thereto. All of the anchoring apertures 7 measured about 0.1250-0.1500 inch in diameter. The staggering of the apertures 7 in each row allows all of the adjacently positioned anchoring apertures 7 to be placed at an equidistant of 0.8563 inches from one another. The two center rows of anchoring apertures 7 contained additional anchoring apertures 7 at each end but the same spacing within rows as with the three rows of apertures 7 sets.

This arrangement of anchoring apertures 7 as illustrated by the magnified cross-sectional view of FIG. 4 firmly anchors the fused plasticized polyvinyl chloride coating 3 on each side to the table top 13 (i.e. the top coating 3A and bottom coating 3B) and conjointly fuses each coating on each coating side 3A and 3B securely together so as to create a substantially uniform fused coating 3 throughout the entire interior surface area portion of the table top 13 securely fused or bonded together by the anchoring apertures 7. The coating 3 is substantially uniform in the terms of conjoint fusion and enveloping of the fused coating 3 about the metal portion 5.

In fabricating table top 13, flat steel stock measuring 0.125" thick×1.50" width×56.375" length serves as a center brace 14C. The peripheral edge 11 of the table top 13 comprises a 197.9375 inch long (before being bent to an angle) angled steel stock measuring 0.1345 inch thick and 2.375 inch wide welded flushly onto the table top 13 10 gauge steel edge. Two terminal end braces 14B each of 0.1875 inch thick, 1.25 inch width and 29.625 inches in length were welded perpendicularly onto the mid-point ends of the center brace 14C and onto the cornering inner edges of peripheral edge 11. A pair of flat steel stock cross braces 14S measuring 0.1875" thick, 1.25" wide and 14.75" long welded perpendicularly on each side of the midpoints of the center brace 14C and the table bordering edge 11 provide center crosswise bracing to the table top 13. A pair of two side lateral flat stock steel braces 14L laterally centered 9.25" from the center brace 14C on each underside and measuring 0.1875 thick, 1" in width and 28.0625 in length were bridged between the terminal end braces 14B and cross braces 14S then welded thereto and appropriate positioning along the table top 13 completes the underside bracing for the table top 13.

During the immersion of the table top 13 in the coating bath, the table top 13 was suspended upon a chain connected to two rods which are welded onto two pair of s-hooks which in turn were welded at an off-set centered position onto the inner rail of the peripheral edge 15S on each end of table top 13. The welded rods which are inserted onto the upwardly extending eyelet positioning of the s-hook allows the dipping bath operator to swing or swivel the immersed table top 13 about the pivotal site of the two suspending chains while the table top 13 is immersed in the coating bath. This technique allows the table top 13 to be placed in a level upright position while being immersed in the unfused plasticized polyvinyl chloride bath and for the bath operator to rotationally move the immersed table top 13 so as to remove entrapped air bubbles and thereby uniformly apply the unfused coating thereto. Since the entire manufacture can be continuously conducted in successive stages by transporting table top 13 to each sequential stage, the supporting s-hooks are useful for transporting table top 13 through these successive manufacturing stages. Thus the hooks may be effectively used to transport the component parts through the internal cleaning, degreasing, preheating, bath immersion, drainage, oven fusing or curing of the coating 3, powder coating, powder coating curing, and overcoating stages of the manufacture before the ultimate removal of the s-hooks from the finished article.

The bench seats 23 depicted in FIGS. 1 and 5 includes both anchoring apertures 7 and leveling apertures 9 while also relying more extensively upon the leveling apertures 9 within the innermost area to create the necessary leveling and anchoring of the fused plasticized polyvinyl chloride coating 3. An angled steel stock metal substrate measuring 158.125 inches×0.1345 inch×2.375 inches curved about the bench seat peripheral bordering edge 24E and welded thereto along with the underside reinforcing bridging seat braces (generally prefixed by 24) to re-enforce bench seat 23. The seat braces 24 include a center seat brace 24C, mid seat braces 24B and terminating end seat braces 24D.

Figure 6:
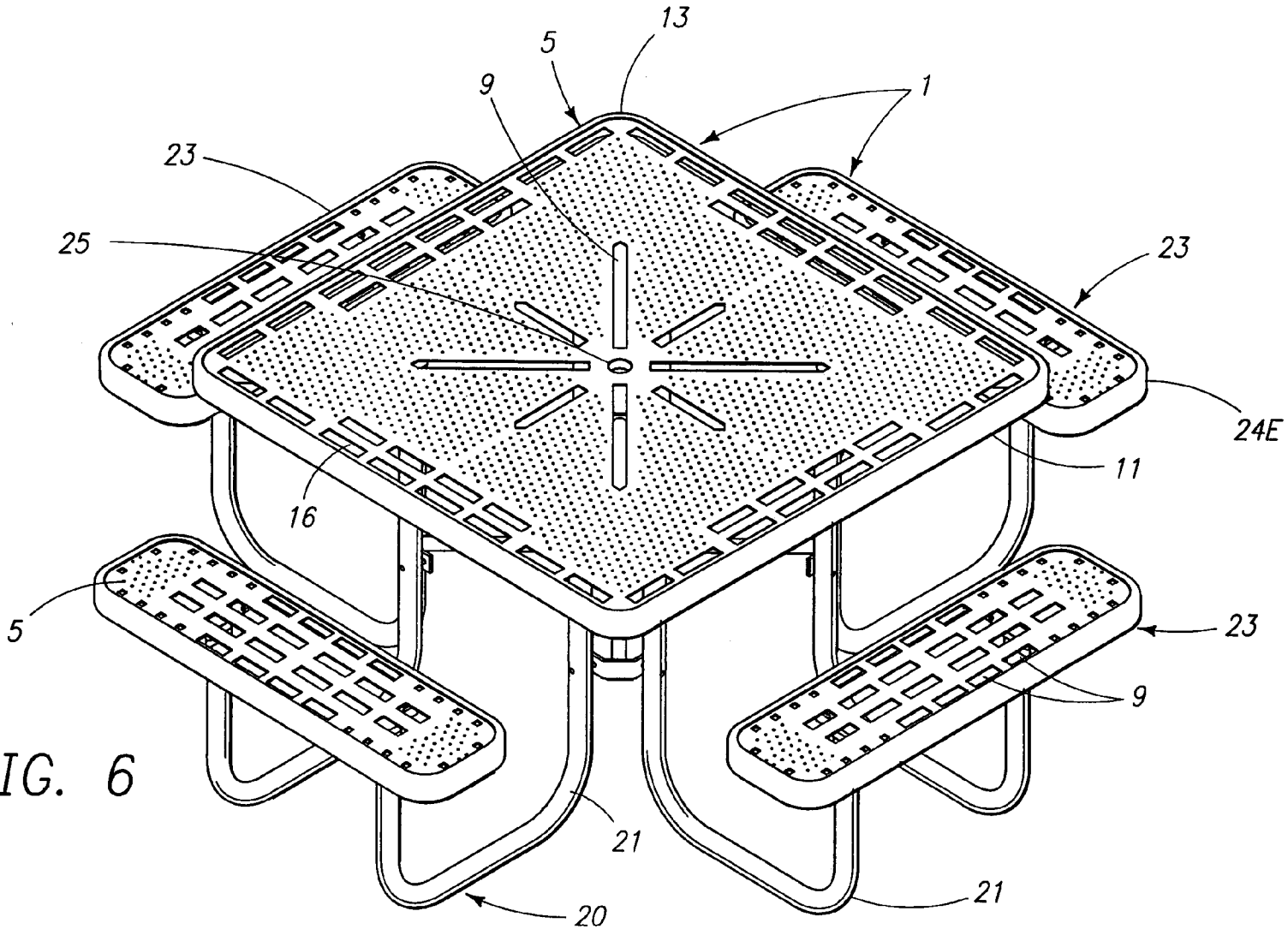
FIG. 6 is an elevational side view of another uncoated picnic table of which the component parts may be uniformly coated with a fused plasticized polyvinyl chloride coating pursuant to this invention.

The bench seat 23 measuring 72 inches×10 inches of 10 gauge steel sheeting includes a series of four slatted lateral leveling apertures 9 in a four set arrangement laterally spaced 1.5405 inches from the bench side edge 24S and at a lateral distance of 1.3 inch from each other. The terminating end margins 24M and measuring about 7.8755 inches by about 10.000 inches were provided with leveling apertures shaped stars 9 of the same size as used in preparing the table top 13 herein. The centriod of each leveling star apertures 9 was placed 2.6155 inches from the bench side edge 24S and 4.2718 inches from the bench seat terminating edge 24D. Forty-two anchoring apertures 7 laterally spaced 0.8563 inch apart as shown in FIGS. 5, 5*a* and 6 were used to firmly anchor and conjointly fuse the fused coating 3 onto the bench seats 23 as depicted in FIGS. 1 and 4.

In the manufacture, a timed continuous conveyor was used to transport the coated parts through a series of processing steps comprised of a preheating oven, an immersion bath, removal from bath to provide the excess coating draining cycle, fusing the coated plasticized polyvinyl chloride coating onto the metal portions 5 and the finishing application of applying a protective overcoating. For those components powder coated, the powder coating technique of U.S. Pat. No. 5,891,574 to Glover et al. was used to replace the immersion bath. In the over all continuous processing, the parts to be coated were hung on horizontal racks, measuring approximately 5 ft. by 7 ft. The processed parts (i.e. metal portions 5) hooked or suspended upon the bathing rack in an uprighted position were moved along the conveyor system in timed sequences of 3½ min. intervals.

The fabricated metal pieces including the table top assembly 13 and bench seats 23 were initially cleaned and degreased using an industrial aqueous cleaning power washer to thoroughly remove any residual oil, grease and dirt from the pieces. The cleaned pieces were then flow coated with metal WB 1425 Clear primer sold and distributed by Polyone, 21300 Doral Road, Waukesha, Wis. 53186.

The primed metal pieces (5) were then placed in transport racks and transported to an air heated oven maintained at about 600 degrees F. for 3/12 minutes preheat the primed metal pieces about 285 degrees F. The preheated pieces were then separately immersed in a 95 degree-100 degree F. bath of plasticized polyvinyl chloride coating composition (plastisol commercially available of 88 Shore A hardness, distributed by Polyone, 21300 Doral Road, Waukesha, Wis. 53186) by raising the coating bath onto the bathing rack for about one minute while the bathing operator gently pivotally rotates the suspended table top 13 and bench seats 23 to displace any air clinging to the immersed table top 13 and bench seat 23. Upon completion of the bathing cycle, the bathing tank is then lowered and the liquid plastisol is allowed to drip off the dip coated part into the bath for the remainder of the draining cycle to provide a uniform coating thereupon. The drained parts (i.e. table top 13 and bench seats 23) were then transported to a preheated air oven maintained at 450 degrees F. and baked 10½ minutes to fuse the plastisol into a homogenous and continuous mass firmly bonded to the primed surface and metal pieces. Effective bonding and full development of the desired fused physical properties of the polyvinyl chloride composition to the primed surface generally necessitates that the coated surface achieve a fusing temperature typically of 350 degrees F. or higher.

A magnified examination of cross-sectional cuts revealed uniform coating measuring 0.1250±0.0625 inch thickness covering each coated side (i.e. top side 3A and bottom side 3B) of the solid portion 5 and the anchoring apertures 7 as depicted by FIG. 4. Measurements of fused coating 3 thickness at the centroid of each anchoring aperture 7 revealed a continuous or solid mass of fussed coating 3 of uniform coating thickness. The one inch leveling apertures 9 cross-sectional diameter was reduced to 0.7500±0.0125 inch by the fused coating 3 thereabout. As illustrated by FIG. 4, the two fused polyvinyl chloride coating 3A & 3B are conjointly fused together through each of the anchoring apertures 7 to create a solid portion 5 sandwiched between two opposing coated surfaces 3A & 3B rigidly fused together by the fused coating 3 bridging there between.

As taught in Example 1 of U.S. Pat. No. 5,891,579 to Glende et al (e.g. see Col 12, lines 8-34), the fused polyvinyl chloride coated articles were then overcoated with a protective overcoating barrier for protectively shielding the polyvinyl chloride coating from atmospheric exposure.

Peel tests were conducted upon the fused coated metallic article 1 of the table top 13 by testing a portion of the fused coating 3 along the rowed apertures of anchoring apertures 7 within the interior portion 17. The peel test revealed the fused coating 3 as being tenaciously anchored to both sides of the coated table top 13 and conjointly fused together as evidenced by peel test readings of 50 lbs. Examination of the fused coating 3 within the tested region revealed a thick, bright and lustrous fused coating of a substantially smooth coated contour measuring approximately 0.0625 (1/16)-0.1875 (3/16) in thickness.

Characteristically of fused coatings 3 upon metal objects 5 coated pursuant the present invention, the fused coating 3 surface was substantially planar in that it was substantially free from abrupt changes in its surface contour.

The contour of the surface was characteristically substantially even and smooth varying at most about ±50% variation in layer thickness while also being substantially free from abrupt surface changes such as the pronounced ridges, depressions or droplet formations upon its surface. The anchoring apertures 7 served to rivet by fusing the two opposing surface coatings 3A & 3B tenaciously together while being firmly anchored onto the solid metal portion 5 sandwiched therebetween.

The same test was repeated upon a table top prepared in the same manner except that the anchoring apertures were eliminated from the interior portions 17 of the table top 13. The interior peel test at the same location as the aforementioned test panel containing the anchoring apertures 7 revealed a significantly inferior peel test reading of 10 lbs.

The same test was then repeated upon the coated table top having the same positioning of the anchoring apertures as in the first test but without the leveling apertures. The resulted fused coating was completely non-uniform with pronounced fused droplets throughout the fused piece.

EXAMPLE 2

Figure 8:
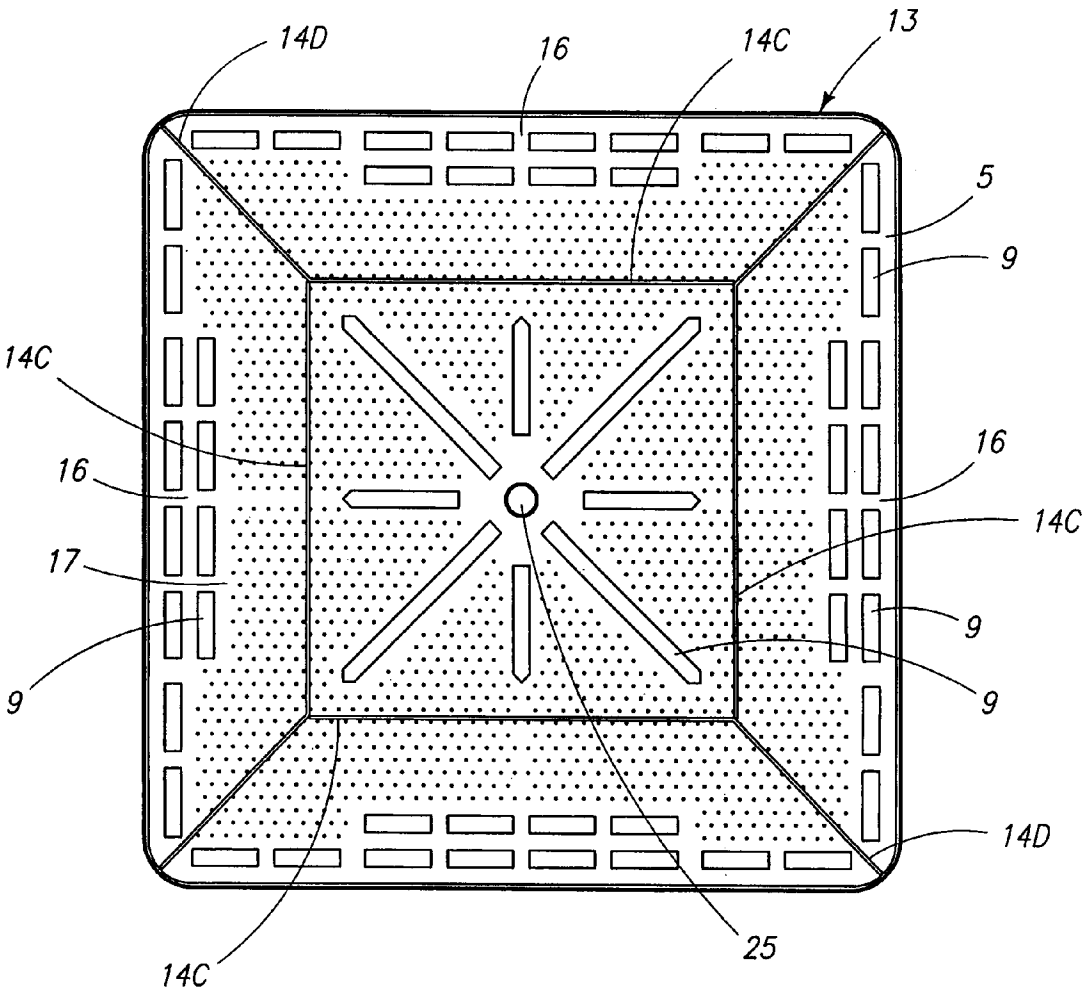
FIG. 8 is a bottom view of a picnic table top used to prepare the coated table top shown in FIG. 7.

The table top 13 and bench seats 23 depicted by FIGS. 6-9 were then made pursuant to the manufacturing techniques as described in Example 1. The table top 13 measuring 14.7 square feet with rounded corners was made from 10 gauge coil steel equipped with a two inch OD Round 12 gauge steel tubing being welded to the center to create a canopy post mount 25. The outer bordering edge 11 of 2.375 inch width by 178.25 inches in length of 10 gauge coil steel stock was then welded onto the table top peripheral edge 11. The underside bracing shown as 14C and 14D were fabricated from a single piece using four identical flat stock pieces, each measuring 0.1875 inch thick×1.50 inch in width×38.625 inches in length, bent at a 135 degree obtuse angle so as to form one center support brace section 14C and one diagonal brace section 14D which when combined together form the underside bracing shown in FIG. 8. The length and 135 degree angular bend of the center support brace section 14C and diagonal brace section 14D when cornered onto the inner cornering bordering edge 11 of table top 13 and each adjacent center support brace 14C section then being placed in a perpendicular relationship to each other will form a centered square of center support brace section 14C as shown in FIG. 8. The underside bracing may then be appropriately integrated into the table top 13 by welding the terminating end of each diagonal brace section 14D to the mating internal bordering edge 11 of the table top 13 and welding the opposite end of each center brace section 14C onto the mating apex bend of each adjacent center brace section 14C along with sufficient weld points to secure the respective center section braces 14C and diagonal section braces 14D to the table top 13 underside.

The outer peripheral margin 16 of the table top 13 was provided with eight leveling apertures 9 placed 1.000 inch apart and each measuring 1.000 inch in width×4.000 inches in length and positioned 1.3030 inch removed from the table edge 11 centered on each side of the square table top 13. Four similarly sized leveling apertures 9 were internally placed at one inch apart and in alignment with the four most innermost leveling apertures 9 on each table side as shown in FIG. 8. The center of the table top 13 was provided with a canopy post holder 25 from which eight elongated leveling apertures 9 spaced at an equidistant radii extended radially outwardly therefrom. The longer radiating leveling apertures 9 measured 13.0699 inch by 1.000 inch while the shorter radially extending leveling apertures 9 measured 7 inches by 1 inch. The anchoring apertures 7 were spaced at a lateral distance 1.1612 inches removed from the leveling apertures 9 with a staggered anchoring aperture 7 placement occurring within each of the sandwiched rows. The anchoring aperture 7 size and placement between anchoring apertures 7 were the same as those of Example 1.

The anchoring apertures 7 of the table top 13 in this example constituted only 1.57% of the total table top surface area while the leveling apertures 9 occupy only 10.49% of the total surface area with the balance 87.94% constituting the solid portion 5. It will be observed that the outer 2.3030 inches peripheral margin 16 of the Example 2 table top 13 contains 31.8% open structure vs. 68.2% solid structure or 45.792 square inches (144 square inches×31.8%=45.792 square inches) open structure per square foot whereas the interior portion 17 contains only 8.2% open structure. The total open space for the Example 2 table top discounting the anchoring apertures 7 amounts to 89.5% of the total table top surface area meaning that only about 10% of the total finished coated surface area is of an open structure.

The bench seats 23 of the FIG. 7 picnic table included seat braces 24 to which the supported legs 21 were bolted onto the other table components including the canopy holder mounts 25 as shown in FIGS. 6 and 7. In the FIG. 6 picnic table, the bench seat 23 anchoring apertures 7 were arranged at the same lateral spacing and staggered relationship as used in the table top 13 but limited in the bench seat 23 towards the bench seat ends. Open and non-expanded structure to the central portion of the bench seat 23 was achieved through use of twenty leveling apertures 9 of a size and lateral spacing between and to the bench side edge as used in the table top 13 herein. Ten smaller sized leveling apertures 9 measuring 0.875 inch square were positioned 1.094 inch from the peripheral edge 23E as depicted in FIG. 6.

The table top 13 and bench seats 23 of this example were coated, drained and fused in accordance with the procedure of Example 1 to produce the coated metallic articles 1 of this invention while powder coating was used to coat the remaining parts The table tops 13 thus made were tested in the same manner as in Example 1. The combination of leveling apertures 9 and anchoring apertures 7 yielded superior peel test results and uniformity in fused coatings 3 on each of the coated table tops 13 as well as the coated and fused bench seats. The cross-sectional view of the fused coated metallic article 1 of FIG. 9 is similar in properties and function to the coated articles 1 of Example 1.

What is claimed is:

1. A method for preparing an article coated with a fused polyvinyl chloride coating from a solid portion containing a prearrangement of anchoring apertures interspersed amongst larger leveling apertures, said method comprising:

a) providing the prearrangement of the anchoring apertures in a sufficient number and uniform distribution throughout an interior portion of the solid portion so as to permit the fused polyvinyl chloride coating to firmly anchor onto the solid portion, b) selectively positioning the larger leveling apertures throughout the solid portion so as to allow an excessive deposition of an unfused plasticized polyvinyl chloride coating material to drain from the solid portion and form a substantially planar coating of the unfused plasticized polyvinyl chloride upon the article covering said anchoring apertures and said solid portion, c) coating the solid portion and anchoring apertures with the unfused plasticized polyvinyl chloride coating material by allowing the unfused coating material to impregnate the anchoring apertures and coat the solid portion therewith, d) permitting excessive deposits of the unfused coating material to drain from the solid portion to provide unfused plasticized polyvinyl chloride coating material of a substantially planar surface covering the solid portion and the anchoring apertures of said solid portion, and e) fusing the unfused plasticized polyvinyl chloride coating material onto the solid portion to provide an article coated with fused plasticized polyvinyl chloride coating of a substantially planar surface covering the solid portion and the anchoring apertures with the fused coating being firmly anchored onto the anchoring apertures of said article;

wherein the solid portion comprises a solid metal portion and the selective positioning of the larger leveling apertures includes the positioning of a greater density of the leveling apertures along the peripheral margin of the solid metal portion than within the interior portion of the solid metal portion; and wherein the leveling apertures comprise an aperture open area amounting to less than 25% of a total surface circumscribed by the peripheral edges of the coated metal article.

2. The method according to claim 1 wherein a substantially uniform distribution of the leveling apertures comprising about 5% to about 15% of a total square surface area of the interior portion are selectively positioned within the interior portion of the solid metal portion.

3. A method for preparing an article coated with a fused polyvinyl chloride coating from a solid portion containing a prearrangement of anchoring apertures interspersed amongst larger leveling apertures, said method comprising:

a) providing the prearrangement of the anchoring apertures in a sufficient number and uniform distribution throughout an interior portion of the solid portion so as to permit the fused polyvinyl chloride coating to firmly anchor onto the solid portion, b) selectively positioning the larger leveling apertures throughout the solid portion so as to allow an excessive deposition of an unfused plasticized polyvinyl chloride coating material to drain from the solid portion and form a substantially planar coating of the unfused plasticized polyvinyl chloride upon the article covering said anchoring apertures and said solid portion, c) coating the solid portion and anchoring apertures with the unfused plasticized polyvinyl chloride coating material by allowing the unfused coating material to impregnate the anchoring apertures and coat the solid portion therewith, d) permitting excessive deposits of the unfused coating material to drain from the solid portion to provide unfused plasticized polyvinyl chloride coating material of a substantially planar surface covering the solid portion and the anchoring apertures of said solid portion, and e) fusing the unfused plasticized polyvinyl chloride coating material onto the solid portion to provide an article coated with fused plasticized polyvinyl chloride coating of a substantially planar surface covering the solid portion and the anchoring apertures with the fused coating being firmly anchored onto the anchoring apertures of said article;

wherein the solid portion comprises a solid metal portion and the selective positioning of the larger leveling apertures includes the positioning of a greater density of the leveling apertures along the peripheral margin of the solid metal portion than within the interior portion of the solid metal portion;

wherein the sufficient number of anchoring apertures outnumber the leveling apertures by at least 10 fold, the anchoring apertures consist essentially of open apertures extending through the metal portion occupy from about 1% to about 3% of the total surface area of the article and the anchoring apertures are characterized as being of a size sufficient to allow the unfused coating material to permeate into the anchoring apertures and form the substantially planar surface covering the solid portion and the anchoring apertures;

wherein the anchoring apertures have an average mean diameter ranging from at least 0.1 inch to less than 0.20 inch and;

wherein a numerical ratio of the anchoring apertures to the leveling apertures ranges from about 30:1 to about 55:1.

4. A method for preparing an article coated with a fused polyvinyl chloride coating from a solid portion containing a prearrangement of anchoring apertures interspersed amongst larger leveling apertures, said method comprising:

a) providing the prearrangement of the anchoring apertures in a sufficient number and uniform distribution throughout an interior portion of the solid portion so as to permit the fused polyvinyl chloride coating to firmly anchor onto the solid portion, b) selectively positioning the larger leveling apertures throughout the solid portion so as to allow an excessive deposition of an unfused plasticized polyvinyl chloride coating material to drain from the solid portion and form a substantially planar coating of the unfused plasticized polyvinyl chloride upon the article covering said anchoring apertures and said solid portion, c) coating the solid portion and anchoring apertures with the unfused plasticized polyvinyl chloride coating material by allowing the unfused coating material to impregnate the anchoring apertures and coat the solid portion therewith, d) permitting excessive deposits of the unfused coating material to drain from the solid portion to provide unfused plasticized polyvinyl chloride coating material of a substantially planar surface covering the solid portion and the anchoring apertures of said solid portion, and e) fusing the unfused plasticized polyvinyl chloride coating material onto the solid portion to provide an article coated with fused plasticized polyvinyl chloride coating of a substantially planar surface covering the solid portion and the anchoring apertures with the fused coating being firmly anchored onto the anchoring apertures of said article;

wherein the solid portion comprises a solid metal portion and the selective positioning of the larger leveling apertures includes the positioning of a greater density of the leveling apertures along the peripheral margin of the solid metal portion than within the interior portion of the solid metal portion;

wherein the coating comprises immersing the solid portion preheated to a coating temperature into a dipping bath containing the unfused coating material to coat the solid portion therewith, removing the solid portion coated with the unfused coating material from the dipping bath and allowing excessive deposits of the unfused coating material to drain from the coated solid portion to provide a coated solid portion having a substantially planar layer of the unfused polyvinyl chloride coating material covering the solid portion and the anchoring apertures and;

wherein the total surface of the leveling apertures ranges from about 5% to about 15% and the total surface occupied by the anchoring apertures is less than 3% of the total surface area of the solid portion.

* * * * *